United States Patent [19]

Massa

[11] 4,450,436

[45] May 22, 1984

[54] ACOUSTIC ALARM REPEATER SYSTEM

[75] Inventor: Donald P. Massa, Cohasset, Mass.

[73] Assignee: The Stoneleigh Trust, Cohasset, Mass. ; Fred M. Dellorfano, Jr. and Donald P. Massa, Trustees

[21] Appl. No.: 420,156

[22] Filed: Sep. 20, 1982

Related U.S. Application Data

[63] Continuation-in-part of Ser. No. 073,309, Sep. 7, 1979, abandoned.

[51] Int. Cl.[3] ..... G08B 17/00

[52] U.S. Cl. ..... 340/531; 181/139; 367/117

[58] Field of Search ..... 367/117, 901, 903; 181/139; 340/531

[56] References Cited

U.S. PATENT DOCUMENTS

| | | | |
|---|---|---|---|
| 3,835,446 | 9/1974 | Rowlands | 367/135 |
| 3,925,763 | 12/1975 | Wadhwani et al. | 340/545 |
| 4,005,384 | 1/1977 | Pryor, Jr. et al. | 367/901 |
| 4,007,330 | 2/1977 | Winters | 367/135 |
| 4,101,886 | 7/1978 | Grimes et al. | 367/117 |
| 4,107,659 | 8/1978 | Massa | 340/552 |
| 4,110,725 | 8/1978 | Petrosky | 367/135 |
| 4,125,826 | 11/1978 | Rasmussen et al. | 367/93 |
| 4,189,720 | 2/1980 | Lott | 340/539 |
| 4,207,559 | 6/1980 | Meyer | 340/531 |
| 4,367,458 | 1/1983 | Hackett | 340/531 |

*Primary Examiner*—Glen R. Swann, III

[57] ABSTRACT

An acoustic alarm repeater system detects a coded alarm signal such as might be produced by a smoke detector or burglar alarm. The alarm signal can vary over a wide dynamic range since the signal will usually be greatly attenuated by intervening walls or floors. The system includes an electroacoustic transducer for converting the coded audible alarm signal into an electrical signal; an amplifier; and an autocorrelator for recognizing the presence of the repetitive characteristic of the coded acoustic alarm signal. Upon detecting the presence of the coded alarm signal, the system generates a new loud warning signal. The processing system may be designed to detect a wide variety of differently coded alarm signals. A dual repeater system recognizes the presence of two differently coded alarm signals, such as one produced by a smoke detector and the other produced by an intrusion alarm, and responds differently to each.

25 Claims, 9 Drawing Figures

ACOUSTIC ALARM REPEATER SYSTEM

BACKGROUND OF THE INVENTION

This invention is a continuation-in-part of my copending Application, Ser. No. 073,309, filed Sept. 7, 1979, now abandoned.

The invention relates to improvements in the recognition of an acoustic alarm signal at a remote point from the source of the signal where the intensity of the signal has become attenuated to such an extent that the direct recognition of the signal is impaired. An illustrative example of the application of this invention is in the recognition of an alarm signal such as may be sounded by a smoke detector when it becomes activated by the presence of smoke. The effectiveness of an alarm signal such as from a smoke detector is dependent on the generation of a loud warning tone that can be easily heard by an individual even when he is remotely located from the alarm signal generator. For example, if a smoke detector located in the basement of a building goes into alarm due to the presence of smoke in the basement, the alarm signal may be too weak to be head in a second floor bedroom, expecially if the person is asleep or if he is listening to a radio or television program.

One attempt to cure this problem has been to install smoke detectors at various locations throughout the building; however, the disadvantage of such an arrangement is that a smoke detector on the second floor, for example, will not become activated until the fire or smoke has reached the second floor, in which case the delay would place the person in greater peril for his safety as compared with his being alerted at the instant when the first unit went into alarm.

Other attempts to solve the problem have included the use of a radio transmitter in the proximity of the acoustic alarm source to broadcast the sound generated by the alarm device throughout the building. Radio receivers installed at remote regions reproduce the radio transmitted alarm signal. Still further attempts to solve the problem have included the use of remote sound generators which are wired to the various alarm units. The disadvantage of these prior art attempts at solving the problem is that the installation of the system is very expensive, especially where several remote alarm signal generators are required throughout all portions of the building.

SUMMARY OF THE INVENTION

The present invention overcomes the drawbacks of the prior art systems for transferring an acoustic alarm signal to regions remotely located from the alarm source by employing a novel self-contained acoustic repeater which is remotely located from the alarm source. The acoustic signal from the alarm source is designed to have a predetermined repetitive coded characteristic. The acoustic repeater contains a microphone which is sensitive to the frequency range of the acoustic alarm signal and a novel electronic circuit, which will be described later, to achieve the recognition of the presence of an alarm signal even when it has become highly attenuated by intervening wall structures between the alarm signal source and the acoustic repeater location. The inventive electronic circuit is designed to recognize the particular characteristics of the coded alarm signal and to positively identify its presence even when its presence is not of sufficient intensity to be recognized by the human ear over the general background ambient noise. Upon the detection of the weak alarm signal, the repeater generates a loud acoustic signal which will alert every one in the general vicinity of the repeater location. In applications where several separated areas are to be alerted, additional repeaters may be located in all of the areas, and they will act together as a network to relay the alarm signal from one repeater to another to instantly alert everyone throughout the entire building.

The primary object of this invention is to improve the recognition of an acoustic alarm signal at a remote point from the source of the signal where the intensity of the signal has become attenuated to such a degree that the direct recognition of the signal is impaired.

Another object of the invention is to improve the recognition of an acoustic alarm signal at remote points removed farther and farther from the source of the alarm by providing acoustic repeaters which are located progressively farther and farther from the alarm source, and each repeater progressively generates an intense alarm signal upon detecting the presence of an attenuated alarm signal generated by its neighbor.

A further object of the invention is to provide means for repeating an acoustic alarm signal at a remote point from the location of the source of the alarm signal for the purpose of increasing the sound level of the acoustic signal and thus alert all remotely located persons to the activation of the alarm.

Another object of the invention is to improve the remote recognition of an acoustic alarm signal by providing a particular code for the acoustic signal and by providing a code recognition circuit in the remote acoustic repeater for the purpose of better recognizing the acoustic alarm signal over the background noise, thereby preventing the generation of false alarm signals by the repeater.

A still further object of the invention is to provide different codes for different alarm signals and to provide the repeater with means for recognizing the different coded signals and to generate correspondingly different repeater alarm signals associated with each of the different received alarm signals.

BRIEF DESCRIPTION OF THE DRAWINGS

These and other objects, features, and advantages of the invention will become more fully apparent from the following detailed description of a preferred embodiment of the invention taken in conjunction with the accompanying drawings, in which.

DESCRIPTION OF THE PREFERRED EMBODIMENT

Figure 1:
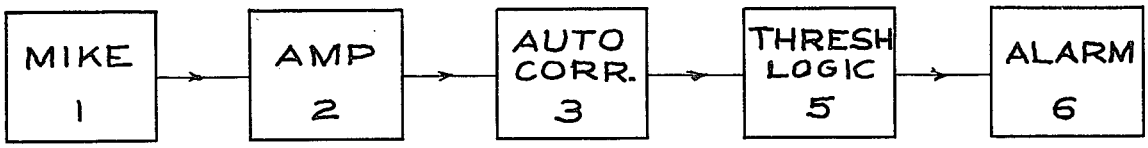
FIG. 1 is a schematic representation of a signal processing means using an autocorrelation method for detecting a coded repetitive acoustic alarm signal whose frequency is known to be within a specified frequency band.

FIG. 1 illustrates schematically an embodiment of this invention. A microphone 1 picks up the acoustic pressure wave in a room and converts it into an electrical signal which is amplified by the amplifier 2. The acoustic pressure wave will include the alarm signal whenever it is present, and it will also include any background acoustic signals that may be present in the room.

The intensity of the alarm signal may vary over a very wide dynamic range. Since acoustic alarm devices generate sound pressure levels in excess of 105 dB ref. 0.0002 microbar, a repeater in the same room with the alarm would be subject to the same sound pressure. However, in adjacent rooms, after being attenuated by intervening walls, the sound pressure level of the alarm signal that the repeater will have to identify may be as low as 35 dB or less. This means that an acoustic alarm repeater may have to operate over widely variable dynamic ranges as large of 70 dB or greater.

The character of the background noises in the vicinity of the repeater is totally random. It could be caused by a wide variety of sources, such as music, machinery, traffic, conversation, appliances, etc. The wide variety of possible noise sources will produce sounds throughout the audible spectrum. Therefore, it is possible for these noise sources to produce sounds that are within the same frequency band as the alarm signal, and with sound pressure levels that may be significantly higher than the sound level of the coded alarm signal that the repeater must recognize. A conventional method of detecting the presence of a low-level signal lying within a specified frequency band in the presence of background noise is to utilize a bandpass filter in the microphone amplifier circuit to discriminate against the noise. However, because of the extremely wide dynamic range of the alarm signal to be detected, the bandpass filter will falsely recognize high-level transient noise signals as being true alarm signals when the transient noise contains frequencies within the same band as the alarm signal.

In order to overcome the inherent limitations of the conventional bandpass filter detection system and be able to detect the alarm signal throughout its wide dynamic range without responding to loud background noise, the inventive system employs a specific coded repetitive signal for the alarm. The coded acoustic signal may consist of a single frequency tone, a signal that alternately turns ON and OFF, a signal that sweeps between two frequency limits, a multi-tone signal that discreetly jumps between one frequency and another, a signal that has a periodic variation in amplitude, etc. One of the important requirements of the coded signals are that their characteristics repeat on a regular basis. For example, if the coded signal is a tone that is ON for a time period $T_1$ and then OFF for a time period $T_2$, it is necessary that these timing cycles repeat continually.

The output of the amplifier 2 in FIG. 1 is fed into the autocorrelator 3. An autocorrelator, as is well known in the art, is a device that recognizes the presence of a periodic signal independently of the average amplitude of the signal. There are many ways to electronically perform the function of autocorrelation. The specific type of autocorrelator that is chosen for autocorrelator 3 is dependent on the repetitive characteristic which is chosen for the code of the acoustic signal as is well known to an electronic engineer skilled in the art. For example, an autocorrelator circuit selected to optimize the detection of a coded signal whose repetitive characteristic is a periodic variation in the relative amplitude of the acoustic signal would be different from an autocorrelator circuit chosen for the detection of a coded signal whose repetitive characteristic is represented by a single frequency tone. A more complete description of several analog and digital autocorrelation techniques is given in U.S. Pat. No. 4,107,659, dated Aug. 15, 1978, which has been issued to Applicant. In this referenced patent, the digital autocorrelators shown could be used to detect coded signals with repetitive characteristics not related to the relative amplitudes of the signals. If the coded signal to be detected, however, contained a repetitive characteristic which is a periodic variation in the relative amplitude of the acoustic signal, an analog autocorrelator such as the one shown in FIG. 13 and discussed in the section entitled, "CIRCLE DETECTOR USING AUTO-CORRELATION OF THE AMPLITUDE OF THE RECEIVED SIGNAL" of the referenced patent could be used.

As an illustrative example, suppose the repetitive coded acoustic signal is a two-toned signal that sounds at a frequency $f_1$ for two seconds, at a frequency $f_2$ for 1 second, at a frequency $f_1$ again for 2 seconds, and then $f_2$ for 1 second, etc., the period of this repetitive coded signal is 3 seconds. The autocorrelator may employ an FM detector which is well known in the art, such as the FM detector shown in U.S. Pat. No. 3,967,260, dated June 29, 1976, which has been issued to Applicant. When the alarm signal is present, the FM detector will generate a square wave output signal of voltage $V_1$ during the 2-second period while $f_1$ is present, and a voltage $V_2$ during the 1-second period while $f_2$ is present. The autocorrelator detects the 3-second repetitive characteristic of the square wave signal produced by the detector. The autocorrelation may be accomplished by any of the autocorrelation systems described in U.S. Pat. No. 4,107,659.

Figure 2:
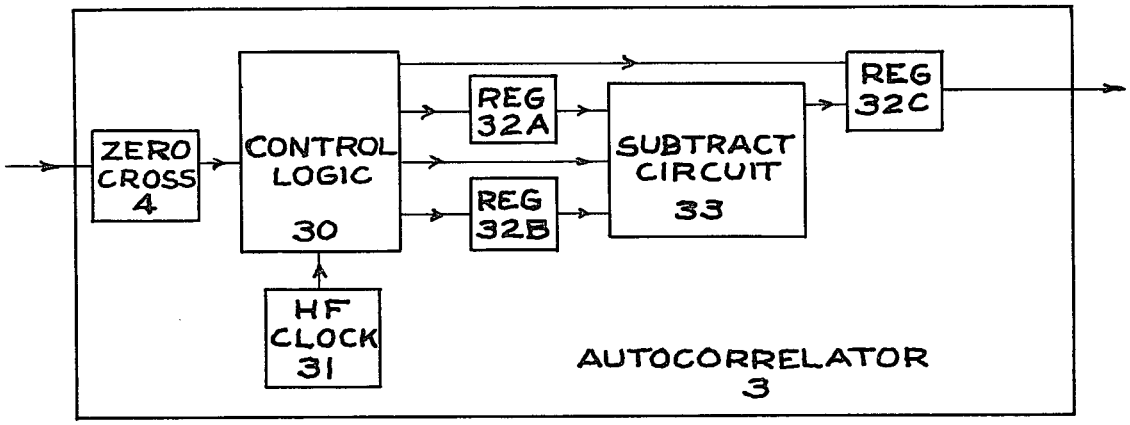
FIG. 2 is a schematic representation of one embodiment of the autocorrelator illustrated in FIG. 1.

Another embodiment of the autocorrelator 3 is shown in FIG. 2. This autocorrelator was designed to recognize a particular coded signal whose repetitive characteristic is a constant frequency tone known to lie within a specified frequency band. One of the simplest alarm signals to produce is a constant frequency tone. Most alarm circuits producing this type of coded characteristic generally utilize inexpensive oscillator circuits which may even use the resonant characteristics of the electroacoustic transducer to control the frequency of the oscillator. Because of this, the exact frequency of the tone is uncertain, but it is known to lie within a specific relatively wide frequency band.

The amplified acoustic alarm signal from the amplifier 2 is fed into the autocorrelator 3. The autocorrelator illustrated in FIG. 2 includes a zero-crossing detector 4 which converts the received signal into square waves whose instantaneous periods are equal to the instantaneous periods of the original acoustic alarm signal. The amplitude of the square wave signal output from the zero-crossing detector is constant over the entire dynamic range of the acoustic alarm signal.

Figure 3:
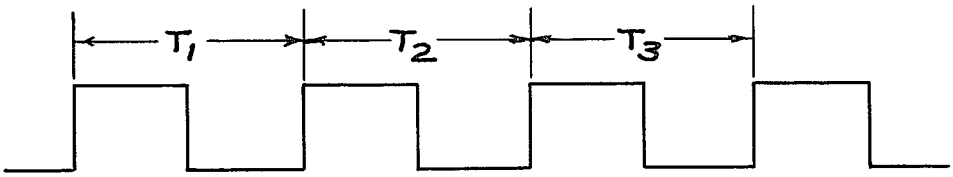
FIG. 3 shows the square wave signal output from the zero-crossing detector in FIG. 2 when a periodic signal is present.
Figure 4:
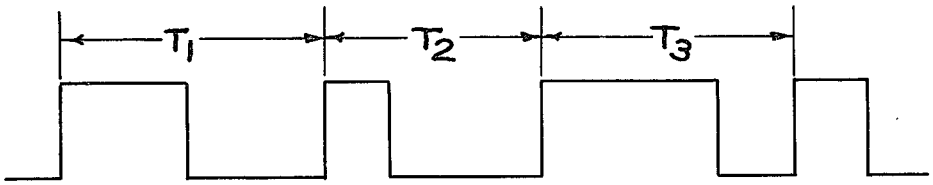
FIG. 4 shows the square wave signal output from the zero-crossing detector of FIG. 2 when a non-periodic signal is present.

FIG. 3 illustrates the output square wave signal from the zero-crossing detector when a periodic signal is present in the acoustic pressure wave in the room. Due to the fact that the coded alarm signal is a constant frequency, the successive periods $T_1$, $T_2$, and $T_3$ will be equal. When a non-periodic signal is present, such as occurs in the presence of random background noise, the output from the zero-crossing detector will have unequal periods, as shown in FIG. 4.

The output from the zero-crossing detector is fed into a control logic circuit 30. This control logic circuit causes a first register 32A to count the number of high-frequency clock pulses from the high-frequency clock 31 that occurs during the first period $T_1$ of the signal. The control logic 30 also causes a second register 32B to count the number of clock pulses that occurs during a subsequent period of the signal. The subsequent periods do not necessarily have to be consecutive periods. The control logic then causes the subtraction circuit 33 to subtract the contents of register 32A from register 32B.

If the signal from the zero-crossing detector 4 is periodic, as shown in FIG. 3, there will be the same number of high-speed clock pulses accumulated in register 32A period $T_1$ as there is accumulated in register 32B during any subsequent period since period $T_1$ is equal to $T_2$, which is equal to $T_3$, etc. The subtraction circuit 33 will, therefore, produce a count of zero. If, however, the signal from the zero-crossing detector 4 is not periodic, as shown in FIG. 4, there will be a different count accumulated in register 32A during period $T_1$ than is accumulated in register 32B during the subsequent period, since the periods are not equal to each other. The subtraction circuit 33 will, therefore, produce a count other than zero when the signal is non-periodic.

The output of the subtraction circuit 33 will add a count into register 32C each time register 32A contains the same count as register 32B. After each subtraction, the control logic 30 resets registers 32A and 32B to zero and repeats the process with two more periods of the signal. If the signal is periodic, subsequent periods will be of the same length and the count in register 32C will keep increasing.

This process can then be continued for a fixed period of time, such as one second, for example. At the end of the fixed period of time, a large number will have accumulated in register 32C if there is good autocorrelation in the received signal. Since good autocorrelation only exists when there is a coded constant frequency present in the signal, there will not be a large number accumulated in register 32C at the end of the fixed period of time when only random noise is present. At the end of the fixed period of time, the control logic 30 will reset register 32C to zero, and the autocorrelation process will continue for the next period of time.

Coded repetitive constant frequency alarm signals generated by electronic circuitry will produce a repetitive stable single line acoustic frequency. In typical alarm installation environments, most background noise sources, such as those produced by motor-driven appliances, may contain line frequencies in their noise spectrums, as well as general broad band noise. An experimental analysis of the noise generated by motor-driven appliances shows wave forms at the output of zero-crossing detector 4 of FIG. 2 which is similar to the periodic signal shown in FIG. 3. However, because of the broad background noise generated by the motor in the vicinity of the line frequency, jitter is produced in the signal.

Figure 5:
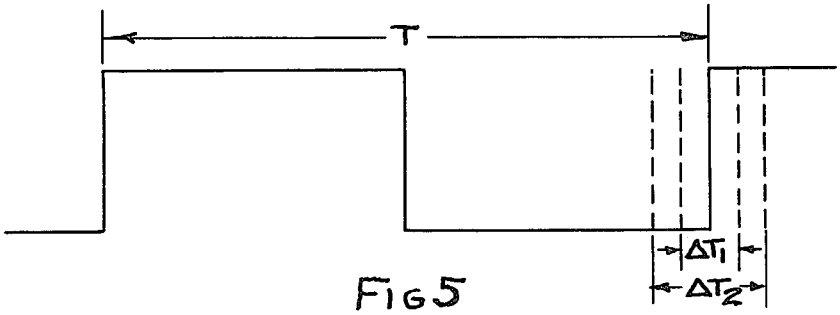
FIG. 5 shows the output signal from the zero-crossing detector of FIG. 2 illustrating the jitter introduced in the period due to the presence of background noise.

FIG. 5 shows the output signal from the zero-crossing detector when a line frequency is present. In the absence of background noise, the period of the signal is T. In the presence of background noise, the zero-crossing changes from period-to-period which introduces a jitter in the period, as illustrated. A relatively small jitter, $\Delta T_1$, is caused by a relatively low background noise, and a relatively large jitter, $\Delta T_2$, is caused by the presence of a relatively large background noise level in the vicinity of the line frequency. In a typical installation, the acoustic alarm signal containing a pure tone will be of greater intensity than the background noise in the frequency range of the tone, and therefore, only a small jitter, as illustrated by $\Delta T_1$ would be present. The autocorrelator 3 of FIG. 2 is adjusted to ignore this small amount of jitter and will recognize the signal as being periodic. One method of accomplishing this adjustment of the autocorrelator would be to allow the subtraction circuit 33 to add a count to register 32C if the difference between the count in register 32A and register 32B is small, but greater than zero. The larger the allowable difference between registers 32A and 32B, the greater the amount of jitter that will be allowed to be present in the acoustic signal and be recognized as periodic by the autocorrelator. If, however, the acoustic signal is produced by an electric motor, the period of the signal represented by T in FIG. 5 will contain a relatively large jitter, as illustrated by $\Delta T_2$. In the inventive system, the autocorrelator is adjusted to ignore any signal having a jitter value greater than a specified value and, therefore, will not false alarm in the presence of appliance-generated background noise.

Since background acoustic noise always exists, the amount of jitter which is introduced in the output of the zero-crossing detector in the presence of the coded periodic alarm signal will increase as the intensity of the alarm signal is reduced and its level approaches the background noise level. In order for the inventive alarm recognition circuit to be effective, the output of the autocorrelator 3 is fed into the threshold logic 5, as illustrated in FIG. 1. The threshold logic will activate the alarm circuit 6 only when the count in register 32C (FIG. 2) exceeds a preset threshold value. This will only occur if the acoustic signal is periodic within the specified jitter limit. The alarm circuit 6 can be made to generate a loud acoustic signal of the same characteristic as the original alarm tone, or it can be made to perform any other alarm function desired as is well known in the art.

Because the autocorrelator 3 is designed to recognize only the repetitive characteristic of the coded alarm signal, neither the relative magnitude of the alarm signal nor the exact frequency of the alarm signal will have any effect on the autocorrelator's recognition ability. The autocorrelator only detects the particular repetitive characteristic of the alarm signal and, therefore, will totally ignore any signal that does not have the specified repetitive characteristic of the alarm signal regardless of the amplitude of the signal. Since the particular autocorrelator used in the inventive system is designed to recognize only the specified repetitive characteristic of the specific coded alarm signal, it will not respond to any other signal, even if the other signal has a repetitive characteristic, so long as the repetitive characteristic is different from the specified coded characteristic signal that the repeater is designed to detect. There are many ways to construct the autocorrelator 3 of FIG. 1 other than the particular circuits that have been described. Therefore, any other circuit that responds only to the particular repetitive characteristic of a specified coded signal is an autocorrelator performing the function of the autocorrelator 3 of FIG. 1.

A single tone alarm signal whose only coding is the period of its line frequency has the inherent limitation of possibly being confused with background noises containing the exact same periodic signals, such as might be produced by musical instruments, whistles, etc. A preferred type of coded alarm signal is an acoustic signal whose repetitive characteristic is not likely to occur in normal background noise. Examples of such preferred coded alarm signal codes that will be more positively recognized in the presence of background noise by the inventive digital processing system are sweep tones, intermittent tones that are modulated ON and OFF at periodic intervals, multi-toned signals that jump back and forth between two or more frequencies, signals whose relative amplitude change periodically, etc. It must be emphasized that these coded signals must have a specific repetitive characteristic in their timing cycles. It is also a requirement that each segment of the codes exists for a sufficient period of time to insure that the reverberation field in the room resulting from the previous segment of the signal has decayed sufficiently so as not to interfere with the signal processing.

Applicant has conducted an extensive theoretical and experimental study to determine the criteria for establishing the timing cycles for these preferred types of coded signals. The reverberation field was studied in many different rooms that ranged from small hard acoustically "live" rooms to large soft acoustically "dead" rooms. The sound field was also studied in other rooms separated from the room containing the original alarm source in which the sound level had been attenuated by the intervening walls. From these extensive tests, it was found that in order to insure that the reverberation field dies down below interfering levels, the alarm signal must be turned OFF for approximately $\frac{1}{4}$ second. Therefore, any coded signal that is turned OFF periodically as part of its repetitive characteristic must remain OFF for approximately $\frac{1}{4}$ second to insure that the signal has died down below detectable levels under all possible practical installations.

Figure 6:
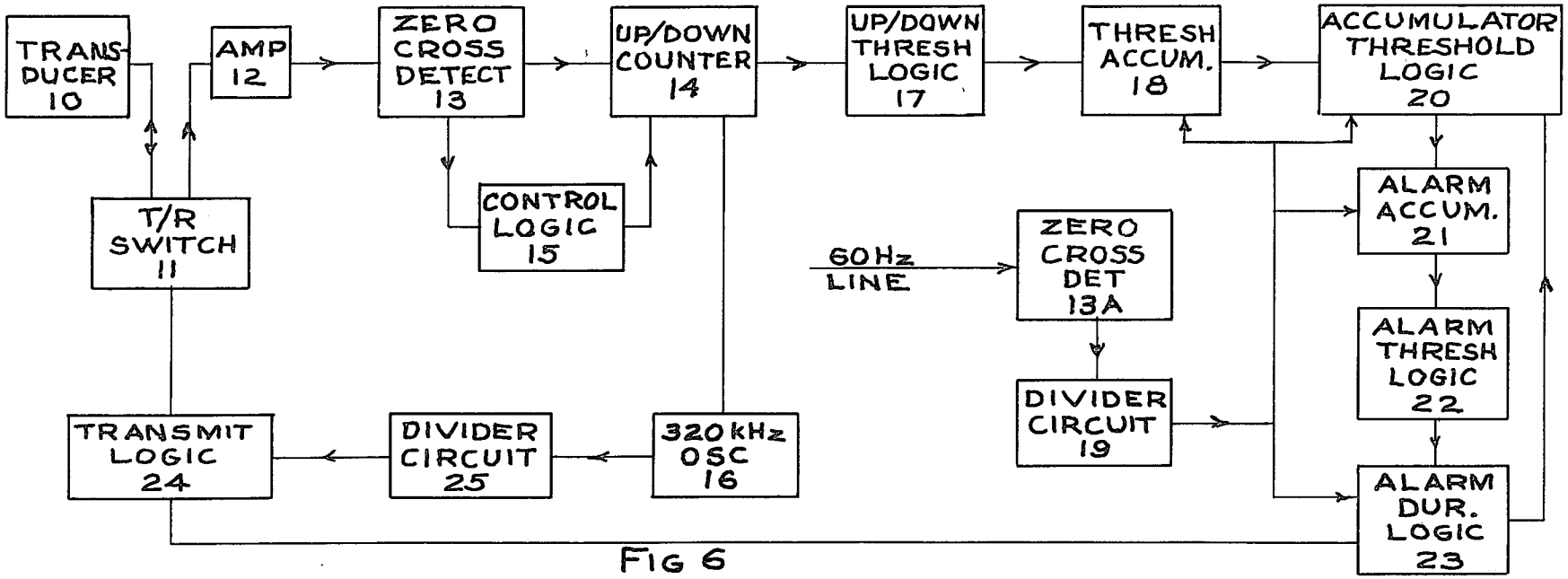
FIG. 6 is a schematic block diagram of an acoustic repeater which enhances the recognition of an acoustic alarm signal by utilizing the teachings of this invention.

One experimental embodiment of the inventive acoustic alarm repeater system having the schematic block diagram shown in FIG. 6 was built and tested. The coded acoustic alarm signal for this experimental repeater is a constant frequency alarm signal which lies within the relatively wide frequency range 2500 Hz±300 Hz. An electroacoustic transducer 10 employs a resonant vibratile diaphragm designed to have a relatively constant receiving response over the frequency band 2500 Hz±300 Hz. The transducer 10 converts the received acoustic alarm signal to an electric signal which is transmitted through the Transmit/Receive switch 11 to the input of amplifier 12. The T/R switch uses back-to-back diodes to protect the amplifier from large voltages when the transducer is transmitting, as is well known in the art.

The output of the amplifier 12 is fed into the zero-crossing detector 13 whose function is to produce a square wave output whose instantaneous period is equal to the instantaneous period of the acoustic signal. The transducer 10, amplifier 12, and zero-crossing detector 13 were designed to produce a square wave output signal that would be exactly equal to the instantaneous frequency of the received acoustic signal on a cycle-by-cycle basis for an acoustic signal within the frequency range 2500 Hz±300 Hz and intensity level between 30 dB and 105 dB vs. 0.0002 microbar.

The output of the zero-crossing detector 13 is fed into the up/down counter 14 and also into the control logic circuit 15. A 320 kHz oscillator 16 supplies a reference clock frequency into the up/down counter 14, as shown. The control logic circuit 15 causes the up/down counter 14 to count the number of 320 kHz clock pulses that occur during one period of the received signal, and to subtract the number of 320 kHz pulses that occur during the next period of the received signal. If the received signal is stable and periodic and is within the frequency band 2500 Hz±300 Hz, the up/down counter 14 will count between 114 and 145 clock frequency pulses during the first period. The second period will contain the identical number of pulses, and, therefore, the exact same number of pulses will be subtracted from the up/down counter 14. The total result of this sequence will be that the number "0" is left in the up/down counter, which indicates that a stable periodic signal is being received.

If the signal from the transducer is not a stable frequency, the two adjacent periods of the signal will not be the same; therefore, a different number of clock pulses will be added to the up/down counter 14 during the first period than will be subtracted during the second period. As a result, a number different from "0" will be left in the up/down counter for this type of signal. If the received signal contains jitter, the frequency will not be stable and the resultant count in the up/down counter 14 will be different than zero. The larger the jitter, the greater the resultant count.

An experimental investigation was undertaken to determine the maximum of jitter (illustrated as $\Delta T_1$ in FIG. 5) that can be permitted in the received acoustic signal so that the inventive system will operate without false alarms in the presence of typical background noise levels. The results of the experimental investigation indicated that a jitter of ±1 clock pulse of 320 kHz was permissible, which is equivalent to a jitter of ±3 microseconds. The output of the up/down counter 14 is fed into the up/down threshold logic 17 which provides an output pulse only if the output from the up/down counter 14 is −1, 0, or +1. No output is provided if the absolute value of the count is greater than 1. Each output pulse from the up/down threshold logic 17 is added to the threshold accumulator 18, which means that the accumulator 18 will increase by a count of 1 every time that there is correlation between two successive periods of the acoustic signal. The threshold accumulator 18 counts pulses from the up/down threshold logic 17 for 1.07 seconds. The threshold accumulator is reset to zero every 1.07 seconds by the pulses transmitted from the output of the divider circuit 19, which establishes the frequency of the reset pulses by dividing the 60 Hz line frequency by 64 after it has passed through the zero-crossing detector 13A, as illustrated in FIG. 6. This means that for a nominal 2500 Hz signal, the threshold accumulator 18 can accumulate up to 1337 counts during a 1.07 second sampling period if there is perfect autocorrelation. Since background noise and its associated normal jitter is always present, it was experimentally found that the actual number of counts in the threshold accumulator 18 was somewhat less than 1337 in each 1.07 second sample, even when a stable periodic alarm signal was present.

The accumulator threshold logic 20 continually samples the number of pulses that have been counted in the threshold accumulator 18. If, at any time, the count exceeds a preset threshold, an activate signal is sent to the alarm accumulator 21. Experimental data taken over a large number of different noise background conditions showed that a threshold level count between 512 and 640 in accumulator 18 as an acceptable compromise range for discriminating against partially correlatable background noise signals containing line frequencies in the vicinity of the alarm signal frequency, such as noise produced by electric motors and the detection of a very low-level true alarm signal. For even greater discrimination against background noises, it would be possible to use multiple thresholds of different levels, such as is described in the correlation process disclosed in U.S. Pat. No. 4,107,659.

The alarm accumulator 21 also receives a pulse from the output of the divider circuit 19 once every 1.07 seconds. If an activate signal is present from the accumulator threshold logic 20, as will occur when an alarm tone is present, the alarm accumulator 21 will add a logic "one" to its counter when the pulse from the divider circuit 19 occurs. If no activate signal is present, the pulse from the divider circuit 19 will reset the alarm accumulator 21 to zero. Each pulse from the divider circuit 19 will also reset both the threshold accumulator 18 and the accumulator threshold logic 20. The alarm threshold logic 22 continually monitors the count in the alarm accumulator 21. If the alarm accumulator reaches a predetermined level, an activate pulse is sent to the alarm duration logic 23 by the alarm threshold logic 22. After many hours of experimental data acquisition, it was determined that a threshold level of 4 for the alarm threshold logic 22 was a good compromise value between discriminating against background noise and detecting a faint alarm signal. This means that four successive 1.07 second sampling periods must produce good autocorrelation for the alarm to be activated. When the alarm duration logic 23 is activated, it disables the accumulator threshold logic 20 and activates the transmit logic 24. The transmit logic produces an electrical signal having the same code characteristics as the original alarm signal which is a 2500 Hz tone. The 2500 Hz is produced by dividing down the 320 kHz signal from oscillator 16 by 128 in the divider circuit 25. The transmit logic 24 applies the generated electric alarm signal to the T/R switch 11, thereby activating the transducer 10 to generate a loud audible alarm signal which has the same coded characteristics as the original alarm signal. The output of the alarm duration logic 23 can also be used to activate any other type of alarm signal, such as lighting or flashing a lamp, or turning on an external horn or siren to alert everyone in the vicinity of the acoustic repeater who might not have heard the original attenuated low-level alarm signal.

In the experimental system described in FIG. 6, it was desired to activate the alarm signal from the acoustic repeater for a period of approximately 13 seconds, and then return to the receive mode to listen again to determine if an alarm signal is still present. In order to do this, the alarm duration logic 23 also receives an output signal from the divider circuit 19, as shown in FIG. 6. The enable signal from the alarm duration logic 23 to the transmit logic 24 is maintained for 12 pulses from divider circuit 19. When the enable signal turns off, the disable signal to the accumulator threshold logic 20 is maintained for another four pulses from the divider circuit 19. This results in a 4.3 second period of total inactivity after each 12.8 second alarm period. The system cannot start autocorrelating the received signal again until a total of 16 clock pulses have been transmitted from divider circuit 19, which is equivalent to 17 seconds after it first went into alarm. If the coded acoustic alarm signal is continuously present, the experimental system will take 4.3 seconds to recognize the signal, then it will transmit an alarm for approximately 12.8 seconds, and then it will "lock out" for approximately 4.3 seconds. While the alarm signal is present, the system will continue to go through its sequence of DETECT, ALARM, LOCK-OUT, DETECT, etc. This cycle will be repeated as long as the original alarm signal is present. If the the original alarm signal stops transmitting, then the repeater will automatically shut itself off.

One of the main advantages of the inventive system is that several repeaters can be used to transmit an alarm signal totally throughout a house, even to areas which are out of acoustic range of the original alarm signal. For example, if a smoke alarm were in the basement of a house, its signal would be completely unheard in a second floor bedroom. However, if a first repeater is located on the first floor within acoustic range of the basement alarm, and a second repeater located on the second floor within acoustic range of the first repeater, the second floor repeater would be easily heard.

When the smoke alarm goes into alarm, the first repeater will detect it after 4.3 seconds and then sound its own alarm. After another 4.3 seconds, the second repeater will detect the sound from the first repeater and then sound its own alarm. As long as the smoke alarm signal is present, each repeater will be continuously going through its cycle of detection for 4.3 seconds, alarm for 12.8 seconds, and lock-out for 4.3 seconds. When the smoke alarm signal stops, the first repeater will stop transmitting and will enter its 4.3 second lock-out period. During the lock-out period of the first repeater, the second repeater will still be sounding its alarm. The second repeater will finish its alarm period at the same time that the first repeater finishes its lock-out period. At the completion of its lock-out period, the first repeater will enter its detection cycle, but since there are no alarm signals present, the first repeater will not enter into its alarm period. Likewise, the second repeater will not detect any alarm signal, so it will not go into alarm. The example given for the operation of the inventive system when two repeaters are used to cover two separate zones can be extended to cover any additional number of repeaters located in additional separated zones. Therefore, by the use of a lock-out period in the operational cycle of the repeater, a multiple repeater system will be able to shut down completely when the original alarm signal stops transmitting. This particular feature is especially useful if the multiple repeater system is being tested, or if a repeater happened to hear a spurious acoustic signal that for a 4.3 second period happened to have, by a remote chance, the same code characteristic as the alarm signal.

When designing the inventive repeater system, many different timing cycles can be employed. In general, it is desirable to minimize the required detection time for the repeater to recognize an alarm signal and to maximize the transmission period for the repeater-generated alarm tone. During ideal quiet background noise conditions, the alarm signal recognition is perfect, and the lock-out time can be reduced to a minimum value of one significant time cycle in the detection routine. In the system shown in FIG. 6, this minimum lock-out would be one count of the divider circuit 19, or 1.07 seconds. However, it may be possible for spurious, loud background noises, such as traffic noise, radio, music, etc., to exist in the vicinity of an operational system. Such spurious noise signals can randomly interfere with the detection capability of the disclosed system during the occasional periods of time when the noise signal contains energy within the frequency band of the original alarm signal.

In the example above discussed, acoustic background noise could interfere with the ability of the second repeater to detect the first repeater's alarm signal. The first repeater could go into alarm, but the background noise might interfere with the detection capability of the second repeater to such a degree that it will not recognize the presence of the alarm signal in 4.3 seconds. Such a random noise interference will extend the detection period, for example, to 10 seconds, which means that the initiation of the alarm cycle of the second repeater will be delayed 5.7 seconds beyond the normal initiation time that would occur in the absence of the spurious background noise.

If the original alarm signal stops, the first repeater will shut off at the end of its 12.8 second alarm period and enter its 4.3 second lock-out period. Under normal conditions, without spurious background noise signals, the second repeater would have completed the 12.8 second alarm period at the end of the lock-out period of the first repeater. However, in the presence of the assumed spurious noise, the alarm period of the second repeater has been delayed by 5.7 seconds. Therefore, the second repeater alarm will be ON during the first repeater's 4.3 second detection period. The first repeater will, therefore, detect the alarm signal from the second repeater, even though the original smoke alarm signal has stopped. In like manner, the second repeater will detect the signal of the first repeater, and a "daisy chain" oscillation will be set up between the two repeaters.

To insure that a daisy chain oscillation will not be set up between two or more repeaters after the original alarm signal stops, it is necessary that the repeater alarm ON period is less than the combined time of the lock-out period, plus the detection period. However, for the repeater to give maximum warning, it is preferable to make the repeater alarm ON period much greater than the detection period plus the lock-out period. In order for the inventive alarm repeater to satisfy both of these requirements, the magnitude of the repeater alarm ON period can be varied during the operation of the system. For example, during the initial stage of operation, when maximum warning is most essential, the alarm ON period is made the larger portion of the total operating cycle. After the passage of a predetermined period of time such as a few minutes, for example, the alarm ON period is automatically changed by the alarm duration logic circuit 23 to become the lesser portion of the total operating cycle. By thus changing the relative time periods within the repeater operating cycle, the inventive system gives maximum initial warning, and subsequently insures that a daisy chain oscillation within a multiple repeater system will not be sustained.

The system illustrated in FIG. 6 is one illustrative method of detecting one type of coded signal. The particular coded signal is one of constant frequency which is known to be within a specified relatively wide frequency range, but the exact value of the constant frequency is unknown. To detect such a signal, the inventive system analyzes the stability of the frequency by comparing the uniformity of two adjacent periods. If two successive periods of the signal are the same within one count of the 320 kHz oscillator 16, then the two periods are considered to be stable. This means that a jitter of $\pm 3$ microseconds is allowable.

Since the upper and lower frequency limits of the coded periodic alarm signal are known, the control logic 15 also contains a digital filter to reject frequencies outside these limits to further discriminate against background noise. For the specific example of a constant frequency alarm signal of $2500 \pm 300$ Hz, the alarm frequencies produce periods that contain between 114 and 145 pulses of the 320 kHz oscillator 16 per period. If any number of pulses outside the range is counted, the control logic 15 ignores the signal and resets the up/-down counter 14. This prevents a periodic signal outside of the specified frequency range from being detected as an alarm signal.

Because the processing logic accepts a jitter of $\pm 3$ microseconds, the system will also detect a sweeping frequency alarm signal as long as the change between adjacent periods is less than 3 microseconds. This means that if the frequency of the alarm signal is sweeping between 2200 Hz and 2500 Hz, it would have to sweep at a rate greater than 80 times per second to prevent the recognition of the sweep frequency. A sweep frequency at a rate of less than 80 sweeps/second will be detected by the processing system above described as a constant frequency alarm signal.

Various other types of coded signals can be detected by the inventive acoustic alarm repeater system, such as intermittent tones that are modulated ON and OFF at regular intervals, two-toned signals that jump back and forth between two frequencies, signals whose relative amplitudes vary periodically, etc. It is also possible to make the inventive repeater system recognize several different alarm tones. Applicant also built a second experimental acoustic alarm repeater designed for recognizing two different coded alarm signals. The first coded signal was a continuous constant frequency tone within the band $2500 \pm 300$ Hz, and the second coded signal was an intermittent constant frequency tone that was ON for 1.5 seconds and OFF for 0.6 second. In this experimental system, the received signal is analyzed in increments of 0.3 second time periods, and a 320 kHz clock compares the stability of adjacent periods of the received signal by means of an up/down counter similar to the circuit shown in FIG. 6.

If there were perfect autocorrelation of adjacent periods of the received signal, the threshold accumulator would accumulate a count of 416 after each 0.3 second measuring period for a 2500 Hz alarm signal. In reality, however, somewhat less than perfect autocorrelation occurs during each 0.3 second sampling period because of the presence of background noise. Therefore, in practice, somewhat less than 416 counts will accumulate during each 0.3 second measuring period. In order to determine how to set optimum threshold limits, an experimental program was undertaken to determine the number of counts that accumulate in the threshold accumulator after each 0.3 second period in different environments representing a variety of different types of background noise conditions. Data were taken with and without the presence of coded alarm signals.

To analyze the system behavior in various environments, a digital to analog converter was built which would produce an analog voltage proportional to the count in the threshold accumulator after each 0.3 second sample time. The relationship between the analog voltage and the count is as follows:

| Analog Voltage Volts DC | Number of Counts in Threshold Accumulator |
|---|---|
| 1 | 28 |
| 2 | 56 |
| 3 | 84 |
| 4 | 112 |
| 5 | 140 |
| 6 | 168 |
| 7 | 196 |
| 8 | 224 |

Figure 9:
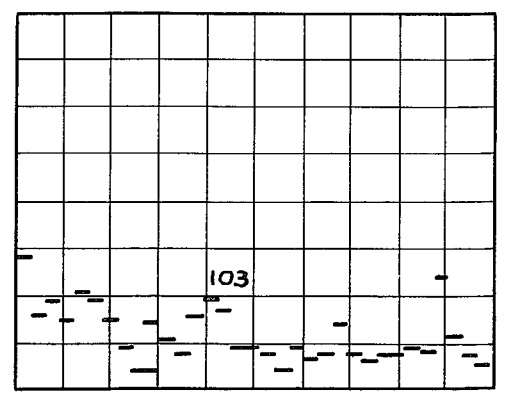
FIG. 9 shows data for the same conditions as in FIG. 7 when only transient background noise is present consisting of loud music at a level of 75 dB.

A large amount of experimental data was collected under various operating conditions with alarm signals ranging in level from 35 dB to 105 dB vs. 0.0002 microbar. The effects of various background noise on the system performance were also measured. Typical experimental data are shown in FIGS. 7 to 9.

Figure 7:
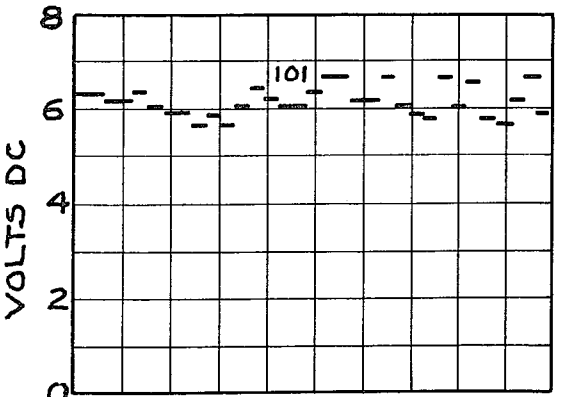
FIG. 7 is an oscillographic reproduction of the output voltage from a digital to analog converter connected across the output of the threshold accumulator in FIG. 6 showing the number of counts accumulated during each successive 0.3 sec. period during the presence of a constant 2500 Hz alarm tone having a sound level of 38 dB within a broad banded background noise level of 33 dB.

Curve 101 in FIG. 7 shows the output of the digital to analog converter in the presence of a constant frequency alarm signal of 2500 Hz at a sound pressure level of 38 dB vs. 0.0002 microbar in a background noise level of 33 dB. The data indicate that the output from the converter is always greater than 4 volts which, in turn, indicates that the count of the threshold accumulator is always greater than 112 during each 0.3 second sampling period.

Figure 8:
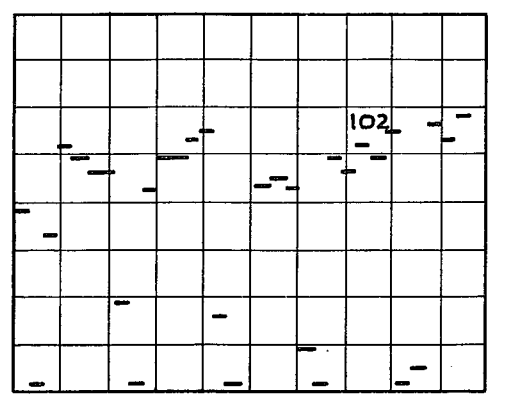
FIG. 8 shows data for the same conditions as in FIG. 7 except that the constant frequency alarm signal is intermittent with periods of 1.5 sec. ON and 0.6 sec. OFF.

Curve 102 in FIG. 8 shows the output of the digital to analog converter for an intermittent 2500 Hz alarm signal that is ON for 1.5 seconds and OFF for 0.6 second. The alarm signal level is 38 dB in a background noise level of 33 dB. The output from the converter is always over 4 volts while the signal is ON and, as can be seen, during the OFF period the output voltage falls very much below 1 volt.

If the alarm signal level increases above 38 dB for either alarm signal, the converter output voltage increases proportionately. However, for the intermittent alarm signal, the converter output voltage drops significantly below 4 volts during the OFF period even when the alarm signal level during the ON period is as high as 105 dB.

Curve 103 in FIG. 9 shows the output of the digital to analog converter in the presence of transient background noise consisting of loud music at a level of 75 dB. The analysis of voluminous experimental data accumulated under a wide variety of background noise conditions showed that loud music gave the highest measured voltage readings at the output of the digital to analog converter. However, even under the worst case condition of background noise, as illustrated in FIG. 9, the output voltage from the digital to analog converter is generally below 3 volts. Based on an analysis of the data illustrated in FIGS. 7 to 9, Applicant developed the following circuit logic truth table for the inventive alarm repeater to optimize the recognition of either a continuous or intermittent acoustic alarm signal, and to minimize the probability of the system false alarming in the presence of background noise. When the acoustic repeater receives an acoustic signal which produces a count greater than 84 at the output of the threshold accumulator (greater than 3 volts in FIGS. 7 to 9) for thirteen successive 0.3 second samples, the signal is recognized as being a periodic coded alarm signal. When the repeater receives a signal which produces a count greater than 84 at the output of the accumulator for five or six successive 0.3 second samples, followed by a count of less than 84 for 1 or 2 samples, followed by a count greater than 84 for 5 or 6 samples, followed by a count less than 84 for 1 or 2 samples, followed by a count greater than 84 for 1 sample, the signal is recognized as being an intermittent coded periodic alarm signal that is ON for 1.5 second and OFF for 0.6 second. The experimental repeater system incorporating this logic was tested under a wide variety of operating conditions and found to function satisfactorily. The repeater consistently identified the two different coded alarm signals when they were present, but it did not false alarm in the presence of a wide variety of background noises.

In certain instances, two differently coded acoustic alarm signals may be present at the same time and the repeater, in addition to being able to recognize each signal individually, is often required to give priority to the recognition of one of the two signals if they are present simultaneously. For example, if one of the alarm signals is generated by a smoke detector, it should be given priority over a second alarm signal generated by an intrusion detector. In the experimental system, recognition priority was given to the continuous periodic coded signal over the intermittent periodic coded signal. This was accomplished because of the fact that during the OFF period of the intermittent alarm signal, the continuous signal, if present, would be detected and priority would be thereby established. Therefore, the two coded alarm signals were chosen so that if both signals were present simultaneously, the resultant combined acoustic signal would only contain the repetitive characteristics of the continuous signal and the repeater system would only recognize this signal. It is obvious that other codes could be used to characterize the different alarm signals that the inventive system is required to detect, and it is equally obvious that more than two different alarm signals may be separately recognized by the logic circuit 5 in FIG. 1 and that any desired priority may be assigned by the logic circuit 5 to a plurality of differently coded alarm signals.

To further improve the recognition of a coded alarm signal by the inventive system, a microcomputer may be used in the processing system for adding more logic to the detection of the coded signal. For example, instead of examining two successive periods, as described, for the detection of the presence of an alarm signal, the microprocessor can permit more complex detection of the alarm signal in the presence of background noise. With the use of a microprocessor, the inventive processing system could compare separated periods such as, for example, every fifth or every tenth period which would permit more sophisticated coding techniques, and the system would have still better threshold detection capabilities with less susceptibility to false alarm in the presence of louder and more diversified noise background.

While there has been shown and described several specific illustrative embodiments of the present invention, it will, of course, be understood that various modifications and alternative constructions may be made without departing from the true spirit and scope of the invention. Therefore, the appended claims are intended to cover all equivalents falling within the true spirit and scope of the invention.

I claim:

1. In combination in an acoustic alarm repeater system, means for the recognition of a coded audible alarm signal, said coded alarm signal characterized in that the frequency of said signal lies within a specified audible frequency band, and further characterized in that said coded audible signal has a specified repetitive characteristic, and still further characterized in that the average intensity level of said coded alarm signal may vary over a dynamic range greater than 20 dB, said signal recognition means including an electroacoustic transducer for converting said coded audible alarm signal into an electrical signal, means for amplifying said electrical signal, an autocorrelator for detecting the presence of the repetitive characteristic of said coded alarm signal, said autocorrelator characterized in that it produces an output signal when said coded alarm signal is present, means for generating a warning alarm signal, means for activating said warning alarm signal generating means, said activating means responsive to said autocorrelator output signal when it is present.

2. The invention in claim 1 characterized in that said repetitive characteristic comprises the frequency of a constant frequency tone alarm signal.

3. The invention in claim 1 characterized in that said repetitive characteristic comprises the variable frequency of a variable frequency tone alarm signal which sweeps over a specified frequency band at a specified periodic rate.

4. The invention in claim 1 characterized in that said specified repetitive characteristic includes successive periods of time during which the coded alarm signal is alternately turned on and off.

5. The invention in claim 4 characterized in that said successive periods of OFF time are of sufficient duration to insure that the reverberation field in the room resulting from a previous period of ON time has decayed sufficiently so as not to interfere with the signal processing.

6. The invention in claim 1 characterized in that said repetitive characteristic comprises the sequential periodic shift among a plurality of different frequencies at a specified repetitive rate of the alarm signal.

7. The invention in claim 6 characterized in that the successive periods of time during which each frequency is activating the system is of sufficient duration to insure that the reverberation field in the room resulting from a previous period of time has decayed sufficiently so as not to interfere with the signal processing.

8. The invention in claim 1 characterized in that said repetitive characteristic comprises the periodic variations in relative amplitude of said coded audible audible alarm signal at a specified repetitive rate.

9. The invention in claim 8 characterized in that the successive periods of time during which each segment of the periodic repetitive cycle is activating the system is of sufficient duration to insure that the reverberation field in the room resulting from a previous period of time has decayed sufficiently so as not to interfere with the signal processing.

10. The invention in claim 1 characterized in that said warning alarm signal contains the same coded characteristic of said coded alarm signal.

11. In combination in an acoustic alarm repeater system for recognition of a coded audible alarm signal, said coded alarm signal characterized in that the frequency of said signal lies within a specified audible frequency band, and further characterized in that said coded audible signal has a specified repetitive characteristic, and still further characterized in that the average intensity level of said coded alarm signal may vary over a dynamic range greater than 20 dB, said signal recognition means including an electroacoustic transducer for converting said coded audible alarm signal into an electrical signal, means for amplifying said electrical signal, an autocorrelator for detecting the presence of the repetitive characteristic of said coded alarm signal, said autocorrelator characterized in that it produces an output signal when said coded alarm signal is present, means for generating a warning alarm signal, means for activating said warning alarm signal generating means, said activating means responsive to said autocorrelator output signal when it is present, said means for activating said warning alarm signal including control means for de-activating said warning alarm signal after a first specified period of time, and further characterized in that said control means includes means for holding said warning alarm signal de-activated for a second specified period of time.

12. The invention in claim 11 characterized in that said second specified period of time is not less than said first specified period of time.

13. The invention in claim 11 characterized in that said alarm repeater system includes a plurality of alarm repeaters and further characterized in that, upon the initial activation of said warning alarm signal by any one of said plurality of alarm repeaters, the said first specified period of time is greater than said second specified period of time, and still further characterized in that said control means includes logic circuit means for changing at least one of said specified time periods such that said second specified period of time is not less than said first specified period of time, and still further characterized in that said logic circuit means is designed to make said time period changes following the continuing reactivation of said warning alarm signal in said alarm repeater after a specified number of consecutive de-activating periods thereby insuring that the alarm system gives maximum initial warning and subsequently insuring that a daisy chain oscillation within the mutiple alarm repeater system will not be sustained between two or more alarm repeaters after the original acoustic alarm signal stops.

14. In combination in an acoustic alarm repeater system, means for the recognition of a plurality of differently coded audible alarm signals, said differently coded audible alarm signals characterized in that the frequencies of said coded audible alarm signals lie within specified frequency bands, and further characterized in that said differently coded signals have different specified repetitive characteristics, and still further characterized in that the average intensity levels of said coded alarm signals may vary over dynamic ranges greater than 20 dB, said signal recognition means including an electroacoustic transducer for converting said coded alarm signals to electrical signals, means for amplifying said electrical signals, an autocorrelator for detecting the presence of the repetitive characteristics of said differently coded alarm signals, said autocorrelator characterized in that it produces at least one output signal when any of said differently coded alarm signals are present, means for generating at least one warning alarm signal, means for activating said warning alarm signal generating means, said activating means responsive to said autocorrelator output signal when it is present.

15. The invention in claim 14 characterized in that said autocorrelator includes means for generating a plurality of different output signals, and further characterized in that a different one of said different output signals is generated for each one of said plurality of differently coded alarm signals, and further characterized in that said warning alarm signal generating means includes means for generating a plurality of different warning alarm signals, and further characterized in that a different one of said different warning alarm signals is generated for a different one of said plurality of autocorrelator output signals.

16. In combination in an acoustic alarm repeater system for the recognition of a plurality of differently coded audible alarm signals, said differently coded audible alarm signals characterized in that the frequencies of said coded signals lie within specified frequency bands, and further characterized in that said differently coded signals have different specified repetitive characteristics, and still further characterized in that the average intensity levels of said coded alarm signals may vary over dynamic ranges greater than 20 dB, said signal recognition means including an electroacoustic transducer for converting said coded alarm signals to electrical signals, means for amplifying said electrical signals, an autocorrelator for detecting the presence of the repetitive characteristics of said differently coded alarm signals, said autocorrelator characterized in that it produces a plurality of different output signals and further characterized in that a different one of said different output signals is generated for each one of said plurality of differently coded alarm signals, means for generating a warning alarm signal, means for activating said warning alarm signal generating means said activating means responsive to said autocorrelator output signals when they are present, said warning alarm signal generating means including means for generating a plurality of different warning alarm signals, and further characterized in that a different one of said different warning alarm signals is generated for a different one of said plurality of autocorrelator output signals, and still further characterized in that the repetitive codes of said plurality of differently coded audible alarm signals are adjusted such that if a plurality of differently coded audible alarm signals are simultaneously present, the combined audible signal will contain only the code of a specified one of said differently coded audible alarm signals thereby establishing a priority for the recognition of a specified one of said plurality of differently coded alarm signals when another of said differently coded alarm signals is present.

17. The invention in claim 1 characterized in that said autocorrelator includes a zero-crossing detector for converting said electrical signal into square waves, means for measuring the periods of a selected plurality of said square waves, and means for comparing said measured periods.

18. The invention in claim 17 characterized in that said period measurement means includes a digital filter.

19. In combination in an acoustic alarm repeater system which includes sound detection means for recognizing a low level coded acoustic alarm signal and sound generating means for generating an intense acoustic alarm signal, said coded alarm signal characterized in that the frequency of said signal lies within a specified audible frequency band, and further characterized in that said coded signal has a specified repetitive characteristic, and still further characterized in that the average intensity level of said coded alarm signal may vary over a dynamic range greater than 20 dB, said sound detection means including an electroacoustic transducer for converting said coded acoustic signal into an electrical signal, means for amplifying said electrical signal, an autocorrelator including a zero-crossing detector, means for connecting said amplified electrical signal to said zero-crossing detector, whereby said zero-crossing detector converts said electrical signal into square waves, means for measuring the differences in the periods among pairs of waves occurring at repetitive specified intervals, means for setting a specified threshold value comparing the relative magnitudes of said measured differences in periods, data storage means for accumulating the number of times that the magnitude of said measured difference in periods exceeds said specified threshold value during a prescribed interval of time, logic circuit means for comparing the accumulated numbers in said data storage means during each prescribed interval of time, said sound generating means including a transducer for generating an intense warning alarm signal, means for activating said warning alarm signal generating means, and control means for operating said activating means when said accumulated numbers in said data storage means exceed a prescribed minimum threshold numerical pattern.

20. The invention in claim 19, characterized in that the repetitive characteristic of said coded acoustic alarm signal comprises the frequency of a constant frequency tone alarm signal.

21. The invention in claim 19 characterized in that the repetitive characteristic of said coded acoustic alarm signal comprises the variable frequency of a sweeping tone alarm signal which is varying between prescribed frequency limits.

22. The invention in claim 19, characterized in that the repetitive characteristic of said coded acoustic alarm signal comprises the frequency and the ON-OFF periods of an intermittent constant frequency tone alarm signal.

23. The invention in claim 19, characterized in that the repetitive characteristic of said coded alarm signal comprises the periodic shifts among a plurality of different frequencies at a specified repetitive rate of a multi-frequency alarm tone.

24. The invention in claim 5 further characterized in that the duration of said successive periods of OFF time are approximately $\frac{1}{4}$ second or greater.

25. The invention in claim 7 further characterized in that said sufficient duration of said system activating time is approximately $\frac{1}{4}$ second or greater.

* * * * *